US007854208B1

(12) United States Patent
Martelli

(10) Patent No.: US 7,854,208 B1
(45) Date of Patent: Dec. 21, 2010

(54) UNIBODY SUPPORT APPARATUS AND METHOD

(76) Inventor: John D. Martelli, 5450 N. W St., Pensacola, FL (US) 32505

( * ) Notice: Subject to any disclaimer, the term of this patent is extended or adjusted under 35 U.S.C. 154(b) by 660 days.

(21) Appl. No.: 11/803,395

(22) Filed: May 14, 2007

(51) Int. Cl.
*D05B 11/00* (2006.01)
*D05B 73/00* (2006.01)

(52) U.S. Cl. ..... 112/117; 112/258

(58) Field of Classification Search ..... 112/117, 112/118, 470.14, 305, 217.1, 475.08, 258; 428/637, 657, 913; 248/637, 657, 913, 676, 248/678, 188.1
See application file for complete search history.

(56) References Cited

U.S. PATENT DOCUMENTS 4,470,361 A * 9/1984 Smith ..... 112/470.12
4,917,756 A * 4/1990 Cahuzac et al. ..... 156/429
5,095,833 A * 3/1992 Darrieux ..... 112/2
5,103,747 A * 4/1992 Resta et al. ..... 112/117
5,145,144 A * 9/1992 Resta et al. ..... 248/637
5,295,452 A * 3/1994 Frye et al. ..... 112/217.1
6,932,008 B2 * 8/2005 Pfeifer ..... 112/117
6,951,178 B2 * 10/2005 Watts ..... 112/118
7,552,691 B1 * 6/2009 Martelli et al. ..... 112/475.08
2009/0272304 A1 * 11/2009 Watts ..... 112/118

* cited by examiner

*Primary Examiner*—Ismael Izaguirre
(74) *Attorney, Agent, or Firm*—J. Nevin Shaffer, Jr.

(57) ABSTRACT

In a structure with two oppositely positioned sides, a unibody support apparatus includes a first preformed side support in the approximate form of a "C" and a second preformed side support in the approximate form of a "C". A side support connector is connected with the first preformed side support and with the second preformed side support such that the side support connector is suspended between and by the first preformed side support and the second preformed side support. And at least one adjustable leg support, connected with the first preformed side support and the second preformed side support, is provided such that the height of the unibody support apparatus may be raised and lowered.

20 Claims, 1 Drawing Sheet

UNIBODY SUPPORT APPARATUS AND METHOD

FIELD OF THE INVENTION

This invention relates to a unibody support apparatus and method for use with structures with two oppositely positioned sides. In particular, in accordance with one embodiment, the invention relates, in a structure with two oppositely positioned sides, to a unibody support apparatus including a first preformed side support in the approximate form of a "C" and a second preformed side support in the approximate form of a "C". A side support connector is connected with the first preformed side support and with the second preformed side support such that the side support connector is suspended between and by the first preformed side support and the second preformed side support. And at least one adjustable leg support, connected with the first preformed side support and the second preformed side support, is provided such that the height of the unibody support apparatus may be raised and lowered.

BACKGROUND OF THE INVENTION

Machines are most useful if they are easy to set up and operate. By way of example only and not by limitation, large sewing machines and quilting machines in particular, are complex, heavy and, typically, hard to use machines. The state of the art is a complex assortment of separate plates, lengths of pipe, bolts and nuts that require a person specifically trained in the assembling of the particular machine to do so. A user is forced to call in "professional" help in order to get the machine assembled the first time and any time thereafter should he or she wish to move or modify it.

Further, the "modern" quilting machines, even when disassembled, contain parts that are too heavy for a single person to handle or too awkward to assemble alone. Thus, there is a need in the art for an apparatus and method that enables the user to simply and easily assemble a machine structure, and specifically a sewing/quilting machine. Therefore, it is an object of this invention to provide a unibody apparatus and method that enables a single user to assemble a support structure that is easy and simple and that does not require professional assistance.

SUMMARY OF THE INVENTION

Accordingly, the unibody support apparatus and method of the present invention, according to one embodiment, in a structure with two oppositely positioned sides, includes a first preformed side support in the approximate form of a "C" and a second preformed side support in the approximate form of a "C". A side support connector is connected with the first preformed side support and with the second preformed side support such that the side support connector is suspended between and by the first preformed side support and the second preformed side support. And at least one adjustable leg is connected, with the first preformed side support and the second preformed side support, such that the first preformed side support and the second preformed side support may be raised and lowered.

According to another aspect of the invention, the first preformed side support and the second preformed side support are approximately identical and interchangeable side to side. In another aspect, the first preformed side support and the second preformed side support include attachment slots for receiving a connector at various controlled locations. In other aspects, the "C" form includes an elongated section for connection with at least one tubular roll; the "C" form includes a top and a bottom and the elongated section is at the bottom of the "C"; and the "C" form includes a top and a bottom and the side support connector is connected with the top of the "C".

In another aspect, the at least one adjustable leg includes a first adjustable leg connected with the first preformed side and a second adjustable leg connected with the second preformed side. In other aspects, the first and second adjustable legs are connected with each other such that movement of one adjustable leg causes an equal movement of the other adjustable leg and in another, the adjustable leg is connected with a motor.

In another embodiment of the invention, in a sewing machine structure with two oppositely positioned sides, a unibody support apparatus includes a first preformed side support and a second preformed side support where the first preformed side support and the second preformed side support include attachment spaces for receiving a connector at various controlled locations and where the first preformed side support and the second preformed side support are in the approximate form of a "C" with an elongated section for connection with at least two tubular rolls. A side support connector is connected with the first preformed side support and with the second preformed side support at the attachment spaces such that the side support connector is suspended between and by the first preformed side support and the second preformed side support. And, a first adjustable leg is connected with the first preformed side support and a second adjustable leg is connected with the second preformed side support such that the first preformed side support and the second preformed side support may be raised and lowered.

According to another aspect, the first preformed side support and the second preformed side support are approximately identical and interchangeable side to side. In other aspects, the "C" form includes a top and a bottom and the elongated section is at the bottom of the "C"; and the "C" form includes a top and a bottom and the side support connector is connected with the top of the "C".

In another aspect, the first and second adjustable legs are connected with each other such that movement of one adjustable leg causes an equal movement of the other adjustable leg; the first and second adjustable legs are connected with a motor; and the first and second adjustable legs include levelers.

According to another embodiment, in a sewing machine structure with two oppositely positioned sides, a unibody support method includes: providing a first preformed side support and a second preformed side support where the first preformed side support and the second preformed side support include attachment spaces for receiving a connector at various controlled locations and where the first preformed side support and the second preformed side support are constructed in the approximate form of a "C" with an elongated section and where at least two tubular rolls are connected with the elongated section, a side support connector connected with the first preformed side support and with the second preformed side support at the attachment spaces such that the side support connector is suspended between and by the first preformed side support and the second preformed side support and where the first preformed side support and the second preformed side support are approximately identical and interchangeable side to side and a first adjustable leg is connected with the first preformed side and a second adjustable leg is connected with the second preformed side such that the first preformed side support and the second preformed side support may be raised and lowered; and connecting a sewing machine with the side support connector.

In other aspects, the "C" form includes a top and a bottom and the elongated section is at the bottom of the "C" and the first and second adjustable legs are connected with each other such that movement of one adjustable leg causes an equal movement of the other adjustable leg. In another aspect, the method includes the step of using the sewing machine to make a quilt.

DESCRIPTION OF THE DRAWINGS

Other objects, features and advantages of the present invention will become more fully apparent from the following detailed description of the preferred embodiment, the appended claims and the accompanying drawings in which:

FIG. 2 is a perspective view of the adjustable legs of the invention according to. FIG. 1.

DETAILED DESCRIPTION OF THE INVENTION

Figure 1:
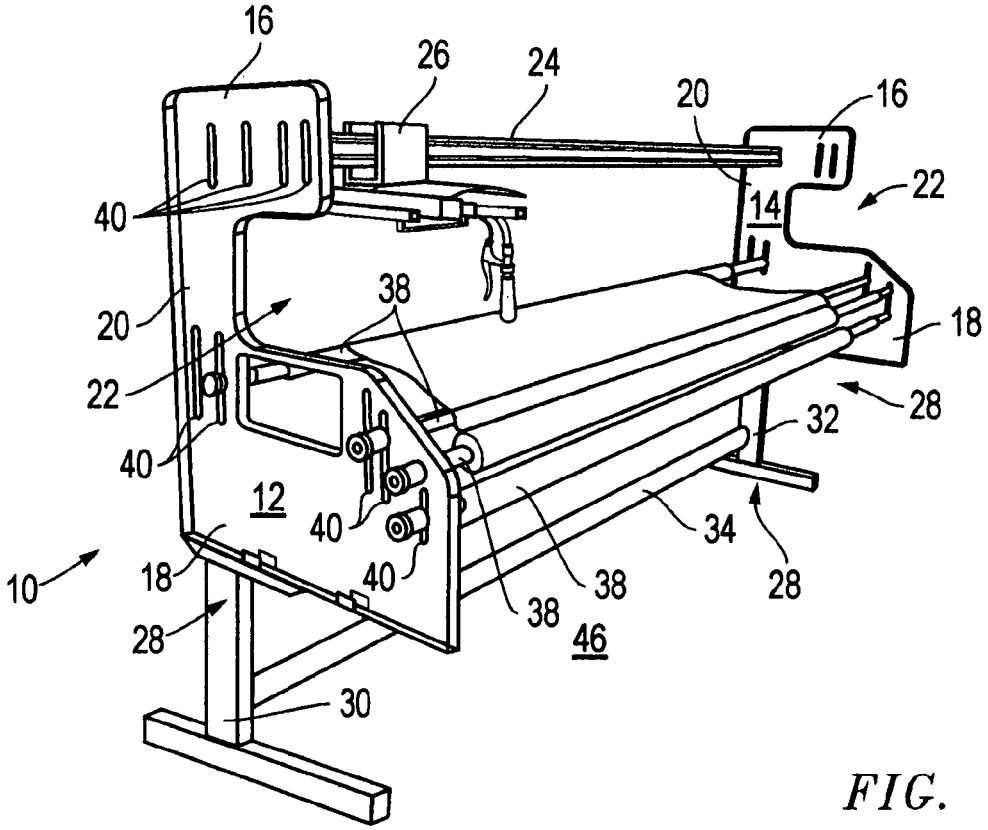
FIG. 1 is a perspective view of the unibody support apparatus and method according to one embodiment of the present invention.
Figure 2:
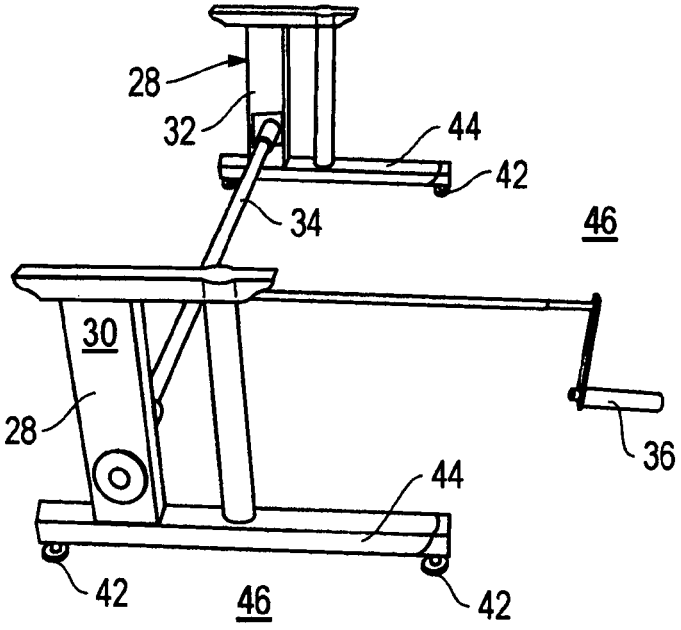

The preferred embodiment of the present invention is illustrated by way of example in FIGS. 1-2. With specific reference to FIG. 1, according to one embodiment, a unibody support apparatus 10 includes a first preformed side support 12 in the approximate form of a "C" and a second preformed side support 14 in the approximate form of a "C". Whereas in the prior art a number of separate pieces of various sized metal plates are used in the construction of a machine frame such as a quilting frame, for example only and not by limitation, Applicant's preformed side supports are a single unified part. This innovation in itself greatly simplifies the construction of a sewing machine structure, such as a quilting frame, as will become more fully apparent hereafter. In any event, made of light weight material such as aluminum or plastic or any other light weight material now known or hereafter developed, a single user can manipulate them, again, as will be more fully described hereafter.

As used herein the term "approximate "C" shape" refers to a shape for the first preformed side support 12 and the second preformed side support 14 that has a top section 16 and a bottom section 18 connected by a back section 20. A cutout section 22 creates a partial space between top 16 and bottom 18 and gives the supports their approximate "C" form or shape. Preferably, the bottom 18 is elongated or extended as compared to the top section 16 as illustrated. Obviously, supports 12 and 14 could be any desired shape, such as rectangular for example only, found useful to the user. Nonetheless, the approximate "C" shape is preferred because it requires less material for the creation of the supports 12 and 14 thereby making them lighter. Further, the cutout 22 creates an open working area from side to side in the unibody support apparatus as illustrated that is useful when creating quilts and the like on such a support.

A side support connector 24 connects first side support 12 and second side support 14. Once connected with first side support 12 and second side support 14 it is suspended between and by the side supports as illustrated. Preferably, side support connector 24 is conformed to receive a carriage 26 to which a sewing machine (not shown) may be attached as more fully described in Applicant's co-pending application for a Support and Cassette Apparatus and Method (U.S. patent application Ser. No. 11/543,453). In any event, side support connector 24 connects the side supports, preferably at the top 16, and adds rigidity to unibody support apparatus 10.

Still referring to FIG. 1, at least one adjustable leg 28 is connected with first preformed side support 12 and second preformed side support 14 (as more fully shown in FIG. 2). FIG. 1 shows a first adjustable leg 30 connected, such as by bolts (not shown) at the bottom 18 of the supports as illustrated, with first preformed side support 12 and a second adjustable leg 32 connected with second preformed side support 14. Adjustable leg 28 is adjustable in that the height of adjustable leg 28 is mechanically adjustable, by hand or motor or otherwise, such that, when attached, movement of adjustable leg 28 up/down results in corresponding movement of side supports 12 and 14 up/down. This is a very useful feature since it enables unibody support apparatus 10 to accommodate users of any height, easily and simply as will be discussed more fully with regard to FIG. 2.

Connection of adjustable leg 28 and/or adjustable legs 30 and 32 also add rigidity to apparatus 10. In one aspect of the invention first adjustable leg 30 is connected with second adjustable leg 32 by leg connector 34 which adds further rigidity. Leg connector 34 may also contain a connection with the movement mechanism, gears for example as known in the art, of the adjustable legs such that movement of first adjustable leg 30 causes and equal movement of second adjustable leg 32. This feature eliminates the need to separately adjust both legs and ensures that both legs move equally thereby keeping the unibody apparatus 10 level.

Still referring to FIG. 1, in a preferred aspect of the invention at least one tubular roll 38 is connected with and between first preformed side support 12 and second preformed side support 14. FIG. 1 shows four tubular rolls 38 connected with supports 12 and 14 in a manner that is known in the sewing and quilting art in which quilting material is wound on the rolls then passed beneath a sewing machine so as to form a quilt and the like. What should be appreciated is that Applicant's unibody support apparatus 10 includes attachment spaces 40, preferably in the form of a series of vertical slots, that provide a selection of attachment options at various controlled locations on side supports 12 and 14. As contrasted with the known machine structures which require multiple pieces to be individually connected and adjusted, Applicant's unibody support 10 makes it easy of the user to connect the two side supports with the side support connector at preselected attachment spaces 40. Likewise with the installation of tubular rolls 38. A single person can assemble the unibody support 10 and then add the tubular rolls 38 one at a time in preformed attachment spaces 40.

Minor adjustments of the side support connector 24 and tubular rolls 38 are provided by the formation of some, but not necessarily all, of the attachment spaces 40 in the shape of elongated slots. As shown in FIG. 1, two tubular rolls 38 are connected with the side supports 12 and 14 at fixed positions and two are connected with attachment spaces 40 that are in the shape of an elongated slots which enable adjustments of the location of the tubular rolls within controlled limits. A series of horizontally aligned attachment spaces 40, in the form of elongated slots, in top section 16 of the side supports 12 and 14 allow a user to adjust the horizontal location, as well as the vertical location, of side support connector 24 if desired.

Referring now to FIG. 2, a pair of adjustable legs 28, first adjustable leg 30 and second adjustable leg 32 are shown. First adjustable leg 30 is connected with second adjustable leg 32 by leg connector 34. Handle 36 is connected with first adjustable leg 30 and, by means of leg connector 34, with second adjustable leg 32 such that movement of the handle 36 causes both adjustable legs 30 and 32 to move up or down as discussed above. Again, the gearing necessary to transmit the motion from adjustable leg 30 to adjustable leg 32 through leg connector 34 is well within the ability of one of ordinary skill in the art and is not disclosed or described further hereafter. Nonetheless, the movement may be effected by mechanical gears, hydraulics, gas or any other means and methods now known or hereafter discovered. Further the adjustable legs may be moved by handle 36 or by a motor (not shown).

Again, in contrast to the state of the art where the height of the total structure is fixed, the ability to simply and easily adjust the height is a tremendous advance for a user. Where it used to require somehow removing the pressure on the supporting legs and unbolting a series of bolts to adjust the height, the present invention makes this simple and easy such that a user can adjust the height at will essentially instantaneously.

FIG. 2 also illustrates another aspect of the invention in which adjustable legs 28 include levelers 42. Levelers 42 are connected with adjustable legs 42 at the bottom 44 of adjustable legs 28 as illustrated. Levelers 42 operate as known to raise or lower the bottom 44 such that the bottom 44 is level on the ground 46. Thus, a user first adjusts levelers 42 to ensure the unibody support 10 is level to begin with. Then, when the height of the unibody support is adjusted by use of the adjustable legs 28, the unibody support 10 remains level.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

The invention claimed is:

1. In a structure with two oppositely positioned sides, a unibody support apparatus comprising:

a. a first preformed side support in the approximate form of a "C" and a second preformed side support in the approximate form of a "C" wherein said first preformed side support and said second preformed side support include attachment slots for receiving a side support connector at various controlled locations;

b. wherein said side support connector is connected with the first preformed side support and with the second preformed side support such that said side support connector is suspended between and by said first preformed side support and said second preformed side support; and c. at least one adjustable leg, connected with said first preformed side support and said second preformed side support, such that said first preformed side support and said second preformed side support may be raised and lowered.

2. The apparatus of claim 1 wherein said first preformed side support and said second preformed side support are approximately identical and interchangeable side to side.

3. The apparatus of claim 1 wherein said "C" form includes an elongated section for connection with at least one tubular roll.

4. The apparatus of claim 1 wherein said "C" form includes a top and a bottom and said elongated section is at said bottom of said "C".

5. The apparatus of claim 1 wherein said "C" form includes a top and a bottom and said side support connector is connected with said top of said "C".

6. The apparatus of claim 1 wherein said at least one adjustable leg includes a first adjustable leg connected with said first preformed side and a second adjustable leg connected with said second preformed side.

7. The apparatus of claim 6 wherein said first and second adjustable legs are connected with each other such that movement of one adjustable leg causes an equal movement of the other adjustable leg.

8. The apparatus of claim 1 wherein said adjustable leg is connected with a motor.

9. In a sewing machine structure with two oppositely positioned sides, a unibody support apparatus comprising:

a. a first preformed side support and a second preformed side support wherein said first preformed side support and said second preformed side support include attachment spaces for receiving a connector at various controlled locations and wherein said first preformed side support and said second preformed side support are in the approximate form of a "C" with an elongated section for connection with at least two tubular rolls;

b. a side support connector connected with the first preformed side support and with the second preformed side support at said attachment spaces such that said side support connector is suspended between and by said first preformed side support and said second preformed side support; and c. a first adjustable leg connected with said first preformed side support and a second adjustable leg connected with said second preformed side support such that said first preformed side support and said second preformed side support may be raised and lowered and wherein said first and second adjustable legs are connected with each other such that movement of one adjustable leg causes an equal movement of the other adjustable leg.

10. The apparatus of claim 9 wherein said first preformed side support and said second preformed side support are approximately identical and interchangeable side to side.

11. The apparatus of claim 9 wherein said "C" form includes a top and a bottom and said elongated section is at said bottom of said "C".

12. The apparatus of claim 9 wherein said "C" form includes a top and a bottom and said side support connector is connected with said top of said "C".

13. The apparatus of claim 9 wherein said first and second adjustable legs are connected with a motor.

14. The apparatus of claim 9 wherein said first and second adjustable legs include levelers.

15. In a sewing machine structure with two oppositely positioned sides, a unibody support method comprising:

a. providing a first preformed side support and a second preformed side support wherein said first preformed side support and said second preformed side support include attachment spaces for receiving a connector at various controlled locations and wherein said first preformed side support and said second preformed side support are constructed in the approximate form of a "C" with an elongated section and connecting at least two tubular rolls are connected with said elongated section, a side support connector connected with the first preformed side support and with the second preformed side support at said attachment spaces such that said side support connector is suspended between and by said first preformed side support and said second preformed side support and wherein said first preformed side support and said second preformed side support are approximately identical and interchangeable side to side and connecting a first adjustable leg with said first preformed side and connecting a second adjustable leg with said second preformed side such that said first preformed side support and said second preformed side support may be raised and lowered; and b. connecting a sewing machine with said side support connector.

16. The method of claim 15 wherein said "C" form includes a top and a bottom and said elongated section is at said bottom of said "C".

17. The method of claim 15 wherein said first and second adjustable legs are connected with each other such that movement of one adjustable leg causes an equal movement of the other adjustable leg.

18. The method of claim 15 further including the step using said sewing machine to make a quilt.

19. In a structure with two oppositely positioned sides, a unibody support apparatus comprising:

a. a first preformed side support in the approximate form of a "C" and a second preformed side support in the approximate form of a "C";

b. a side support connector connected with the first preformed side support and with the second preformed side support such that said side support connector is suspended between and by said first preformed side support and said second preformed side support; and c. a first adjustable leg connected with said first preformed side and a second adjustable leg connected with said second preformed side, such that said first preformed side support and said second preformed side support may be raised and lowered and wherein said first and second adjustable legs are connected with each other such that movement of one adjustable leg causes an equal movement of the other adjustable leg.

20. The apparatus of claim 19 wherein said first preformed side support and said second preformed side support are approximately identical and interchangeable side to side.

* * * * *